United States Patent [19]

Riggenmann

[11] Patent Number: 4,600,365

[45] Date of Patent: Jul. 15, 1986

[54] DISPLACEMENT PUMP FOR LOW-PULSATION DELIVERY OF A LIQUID

[75] Inventor: Hansjürgen Riggenmann, Munich, Fed. Rep. of Germany

[73] Assignee: Gynkotek Gesellschaft fur den Bau wissenschaftlich technischer Gerate m.b.H., Fed. Rep. of Germany

[21] Appl. No.: 720,050

[22] Filed: Apr. 4, 1985

Related U.S. Application Data

[63] Continuation of Ser. No. 463,806, Feb. 4, 1983, abandoned.

[30] Foreign Application Priority Data

Feb. 4, 1982 [DE] Fed. Rep. of Germany ..... 3203772

[51] Int. Cl.[4] ..... F04B 9/08; F04B 25/00

[52] U.S. Cl. ..... 417/246; 417/265

[58] Field of Search ..... 417/265, 254, 244, 256, 417/258, 267, 246

[56] References Cited

U.S. PATENT DOCUMENTS

| | | | |
|---|---|---|---|
| 3,172,363 | 3/1965 | Bennett et al. | 417/238 |
| 4,003,679 | 1/1977 | McManigill | 417/246 |
| 4,067,666 | 1/1978 | Richards | 417/265 |
| 4,236,877 | 12/1980 | Curtis | 417/265 |
| 4,245,963 | 1/1981 | Hutchins et al. | 417/265 |
| 4,352,636 | 10/1982 | Patterson et al. | 417/265 |

FOREIGN PATENT DOCUMENTS

| | | | |
|---|---|---|---|
| 1534650 | 12/1978 | United Kingdom | 417/265 |

*Primary Examiner*—Cornelius J. Husar
*Assistant Examiner*—Peter M. Cuomo
*Attorney, Agent, or Firm*—Sughrue, Mion, Zinn, Macpeak, and Seas

[57] ABSTRACT

A low-pulsation displacement pump comprises two series-connected cylinders which are controlled by valves so that the delivery takes place only in one direction. The pistons of the cylinders are controlled through cams which are driven jointly at a constant velocity. The cams are so formed that the transition phase preceding the delivery phase (in the direction of delivery) of the after-cylinder is longer than the transition phase preceding the delivery phase (delivery direction) of the forward cylinder. In another embodiment, the transition phase preceding the delivery phase of the after-cylinder is greater than 60°. A further embodiment comprises combining the transition phase preceding the delivery phase of the after-cylinder with an isocratic phase and an overlapping phase.

6 Claims, 11 Drawing Figures

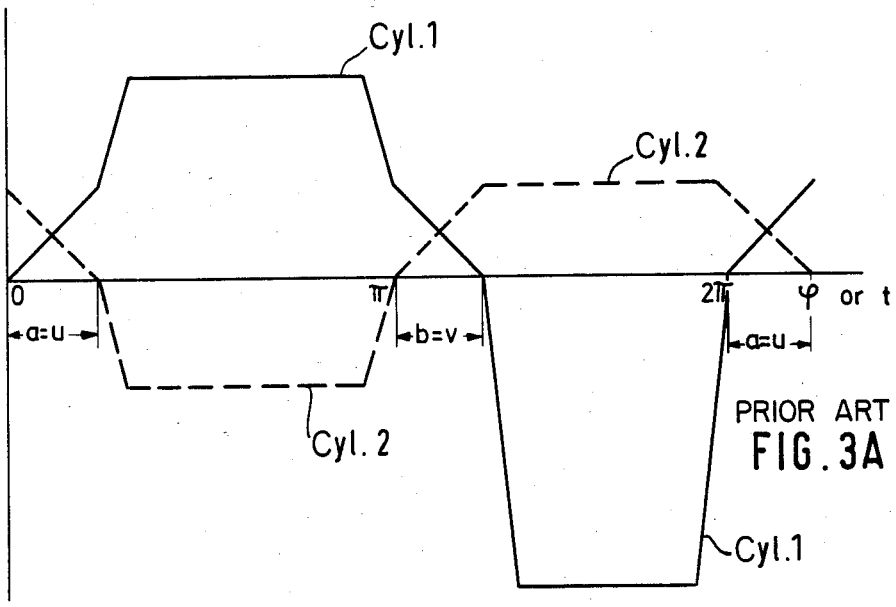
PRIOR ART
FIG. 3A
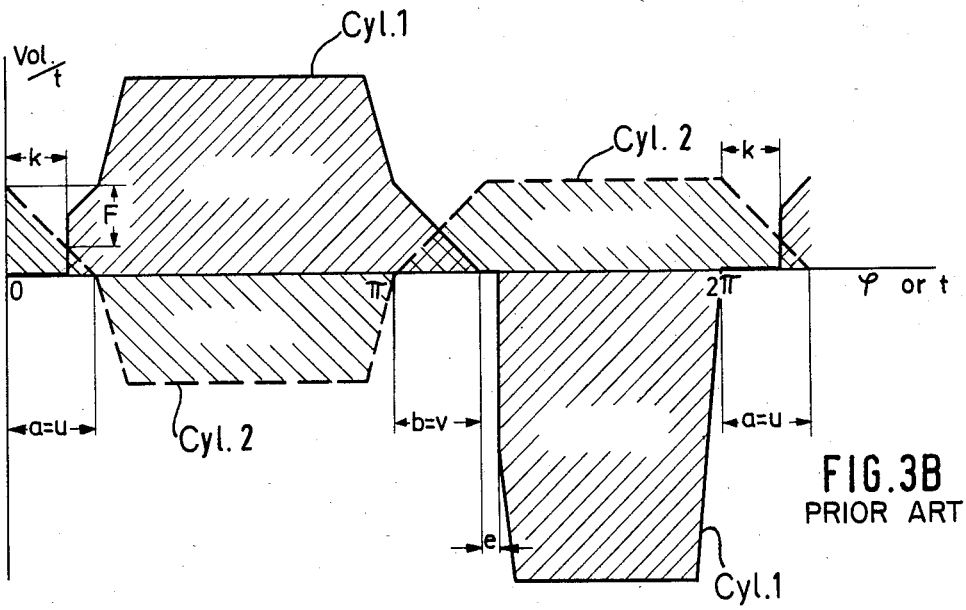
FIG. 3B
PRIOR ART
PRIOR ART
FIG. 3C
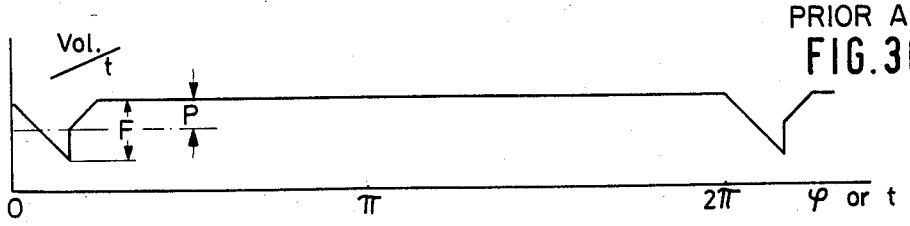

DISPLACEMENT PUMP FOR LOW-PULSATION DELIVERY OF A LIQUID

This is a continuation of application Ser. No. 463,806 filed Feb. 4, 1983, now abandoned.

TECHNICAL FIELD OF THE INVENTION

This invention relates to a positive displacement pump for low-pulsation delivery of a liquid with two series-connected cylinders which, by means of valves, deliver in a single direction, the pistons of which, by means of cams driven by a driving means, are so controlled that, while one produces suction, the other delivers, wherein the after-cylinder (in the direction of delivery) in its delivery phase takes over the entire delivery as well as the filling of the forward cylinder and wherein, between each delivery phase and suction phase of the cylinders, a transition phase occurs in which the cylinder entering its delivery phase compensates for the loss of delivery of the cylinder entering its suction phase.

BRIEF DESCRIPTION OF THE PRIOR ART

Positive displacement pumps of the type described are known. The transition phase in the case of these known displacement pumps includes an overlapping phase in which the volume of delivery of both cylinders linearly increases or decreases in dependence on the rotation angle of the cams. For each full rotation of the cams two transition phases occur which, in the case of the known displacement pumps, are equally long and which extend over an angle of less than 60° based on a full revolution of the cams. An ideal liquid, i.e. a non-compressible liquid, can, with a displacement pump of the foregoing type, be delivery pulsation-free. On the other hand, the delivery of real liquids which occur exclusively in practice when one uses displacement pumps of the type described, is burdened necessarily with pulsation. The cause of the pulsation lies in the fact that, when the displacement pump must pump against a certain back-pressure, the delivery of the after-cylinder is initially delayed because the liquid to be delivered undergoes at first a volume diminution in a compression phase. The end of the compression phase depends on the compressability of the liquid, the pressure against which delivery occurs and possibly other parameters as, for example, temperature and system elasticity.

Low pulsation or pulsation-free pumps find application in chromatography. Most frequently, one found in this area, up until now, displacement pumps with two parallel-connected cylinders. Even in the case of such displacement pumps pulsation occurs for the elimination of which one changes the rotational driving velocity of the cams for the pistons of both cylinders during each rotation (DE-PS No. 27 37 062 and U.S. Pat. No. 3,917,531). The necessary throughput meters and the apparatus for regulating the drive means are relatively expensive.

OBJECT OF THE INVENTION

The invention proceeds from the finding that, in connection with the use of such pumps in chromatography, as a rule, a slight pulsation is tolerable and can be made harmless by damping. Accordingly, the invention has as its object to construct a displacement pump of the type previously described in such a manner that the pulsation arising from the compressability of the liquid to be delivered is as small as possible and does not exceed a specific amount.

The invention rests on the knowledge that the actual pulsation, i.e. the actual interruption of delivery under otherwise equal operating conditions, is correspondingly less, the greater is the ratio of the transition phase to the delivery phase of the after-cylinder for a complete pumping cycle. This is because, for a small piston velocity over a longer period of time, the same compression is obtainable as with a higher piston velocity over a shorter time period. If, however, the displacement velocity of the piston of the after-cylinder in the transition phase preceding its delivery phase is small, then the displacement velocity for the forward cylinder in this transition phase must be correspondingly small. Thereby it is insured that the delivery interruption, or the actual amplitude of pulsation, is smaller than in the other case. In the transition phase preceding the delivery phase of the forward cylinder no delay of delivery occurs since compressed liquid is forwarded to the forward cylinder by the after-cylinder. Consequently, the transition phase preceding the delivery phase of the forward cylinder can be shortened relative to the transition phase preceding the delivery phase of the after-cylinder.

If the allowable pulsation amplitude is specified in advance, then a first embodiment, in view of the knowledge previously described, consists in maintaining the transition phase preceding the delivery phase of the after-cylinder so long that the decrease in delivery of the forward cylinder up until the end of a compression phase, which delays the beginning of delivery by the after-cylinder, is equal to or less than the given allowable pulsation amplitude.

A second embodiment, with which the first solution is combinable, consists in making the transition phase preceding the delivery phase of the after-cylinder longer than the transition phase preceding the delivery phase of the forward cylinder.

A third embodiment which is, in turn, combinable with each of the previously described solution, consists in holding the transition phase preceding the delivery phase of the after-cylinder over an angle of more than 60° based on a full revolution of the cam for a complete cycle for this cylinder.

In order to ensure that the displacement pump has a small pulsation for all possible liquids to be delivered and for various operating parameters, the transition phase preceding the delivery phase of the after-cylinder should advantageously extend over an angle of 90° or more. For displacement pumps of the type described, i.e. those with series-connected cylinders, it is even possible that the transition phase preceding the delivery phase of the after-cylinder extend over an angle of 180° or more.

A fourth embodiment proceeds from the fact that, in the case of the known displacement pumps, the transition phase is an overlapping phase in which the delivery of the cylinder entering the suction phase continuously decreases and the delivery of the cylinder entering the delivery phase continuously increases in equal measures. The fourth embodiment then consists in interposing an isocratic phase between the delivery phase of the forward cylinder and the overlapping phase which follows thereafter in which isocratic phase the forward cylinder continues its delivery in diminished although essentially constant degree and the after-cylinder begins an essentially constant delivery which compensates for the delivery diminution of the forward cylinder.

In the application of this concept, the isocratic phase, in the case of a given allowable pulsation amplitude, is to be held so long that the end of a compression phase which delays the onset of delivery of the after-cylinder lies inside the isocratic phase and the delivery diminution of the forward cylinder in the isocratic phase is equal to or less than the predetermined pulsation amplitude.

The concept of the fourth embodiment is likewise combinable with the three other solutions.

A displacement pump which is constructed according to one, or a combination, of the foregoing embodiments distinguishes itself not only by a defined low pulsation but also by the fact that expensive pressure-measuring and control devices are unnecessary. Such a displacement pump is thus extremely simple and inexpensive.

BRIEF DESCRIPTION OF THE DRAWINGS

An embodiment of the invention will hereinafter be described in connection with the drawings, wherein

FIGS. 3A, 3B and 3C are diagrams of curves characteristic of a displacement pump of the type shown in FIG. 2 and known in the prior art;

DETAILED DESCRIPTION OF THE PREFERRED EMBODIMENTS OF THE INVENTION

Figure 1:
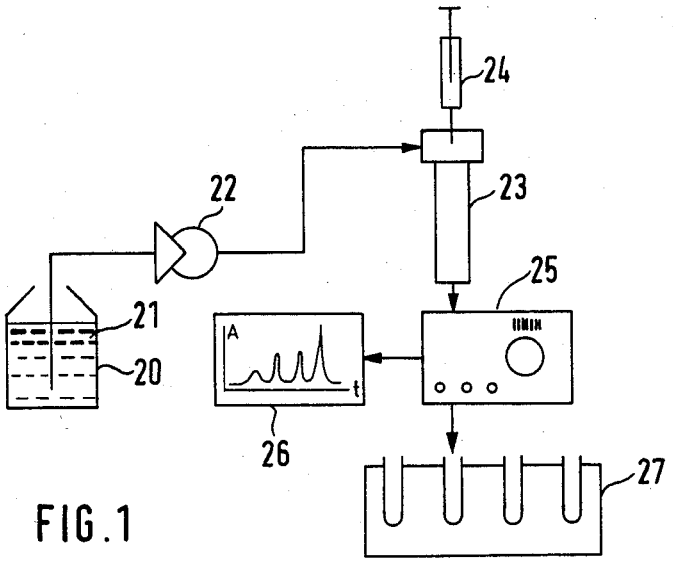
FIG. 1 is a block diagram of a high-throughput liquid chromatography apparatus in which a displacement pump according to the invention finds application.

The high-throughput liquid chromatography apparatus (abbreviated HPLC apparatus) shown in FIG. 1 serves for the separation of materials of a mixture and for the determination of the amount of the individual materials in the mixture. The mixture to be investigated is injected into a separation column 23 by an injector 24. A pump 22 draws a liquid solvent 21 from a storage vessel 20 and pumps it with as little pulsation as possible, or pulsation-free, into separation column 23. The separation column 23 contains a fine-grain absorption material which presents to the solvent and the accompanying and dissolved mixture a relatively high flow resistance. While the liquid flowing out of the separation column 23 has a practically normal pressure (atmospheric pressure), the pressure of the liquid at the entrance of the separation column 23 is significantly higher. A typical value is, for example, 100 bar. Against this relatively high pressure the pump 22 must operate.

The individual materials of the mixture have different times of passage through the column. This means that the individual materials of the mixture pass through the separation column 23 at different velocities. This is because the granular absorption material functions with different separation action toward the materials to be separated.

A detector 25 controls a recorder 26 which produces a chromatogram consisting of successive impulses of different amplitudes A. The impulses represent the individual materials to be separated. The liquid flowing out of the detector 25 is then led to a fraction collector 27.

Since the results of measurement have the form of impulses one must be careful to avoid disturbing impulses as much as possible because these vitiate the results of measurement. Disturbing impulses can, for example, have their origin in a pulsation occurring through the compression of the solvent by the pump in the stream of solvent supplied. If the pulsation amplitude is not too great it can be damped out and does not disturb. If, however, it exceeds a certain magnitude, then the disturbances mentioned can occur.

Figure 2:
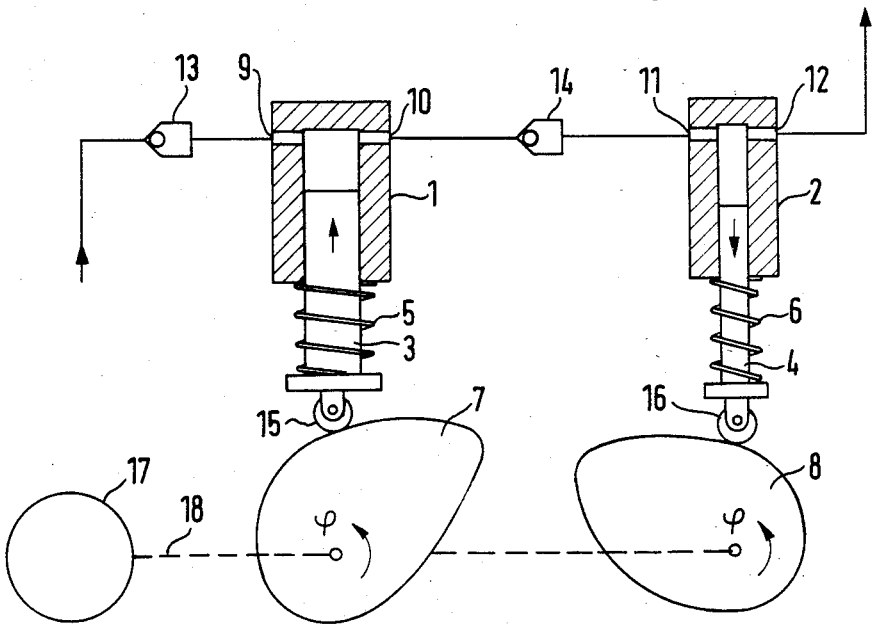
FIG. 2 is a schematic representation of displacement pump of the type involved here.

The pump according to FIG. 2 consists of an after-cylinder 1 (in the direction of the delivery) and a forward cylinder 2. The after-cylinder 1 has a larger delivery volume than the forward cylinder 2. Both cylinders 1 and 2 are connected in series. At the entrance 9 of after-cylinder 1 is a check valve 13. Between the outlet 10 of the after-cylinder and the inlet 11 of the forward cylinder is also a check valve 14. At the outlet 12 of the forward cylinder 2 no valve is needed. Both valves 13 and 14 are so connected that they allow flow in the delivery direction between inlet and outlet.

Piston 3 for after-cylinder 1 is urged by a spring 5, with a wheel 15 at its end, against cam 7. Piston 4 for forward cylinder 2 is urged by spring 6, with a wheel 16 at its end, against cam 8. Both cams 7 and 8 are mounted on a common shaft and are driven by a motor 17. The drive occurs with constant velocity in so far as a small pulsation is tolerable, as hereinafter described. It is, however, also possible to cancel out completely the pulsation by variation of the rotary velocity of motor 17 as described, for example, in U.S. Pat. No. 3,917,531. Basically, however, the pump is distinguished by corresponding dimensioning of the form of cams 7 and 8 according to the invention in that regulation of the motor is unnecessary in view of the small amplitude of pulsation.

The volume of after-cylinder 1 is, therefore, larger than that of forward cylinder 2 because after-cylinder 1 must fill forward cylinder 2 while the latter produces suction. During the suction phase of after-cylinder 1, forward cylinder 2 takes over the delivery.

FIGS. 3A to 3C show diagrams which correspond to the usual prior forms of cams 7 and 8. FIG. 3A shows the dependence of piston velocity of both cylinders on cam angle $\phi$ or time t which, for constant drive of cams 7 and 8, is directly proportional to the cam angle $\phi$.

The curves in FIG. 3A correspond to the dependence of the delivery volume per unit time by both cylinders on the cam angle $\phi$ or time t in FIG. 3B. One can recognize that the curves of FIG. 3B and of FIG. 3A agree to a great extent. This finds its explanation in the fact that delivered volume per unit time by each of the two cylinders at constant cam velocity is directly proportional to the piston velocity. One can recognize that each of the two cylinders has a delivery phase and a suction phase. Between the delivery phase and the suction phase of the cylinders a transition phase occurs. Before the delivery phase of after-cylinder 1, the transition phase occurs. This is in the present case identical to an overlapping phase a in which the delivery by cylinder 1 increases linearly while the delivery by cylinder 2 decreases linearly. Before the delivery phase of cylinder 2, transition phase occurs. This is in the present case identical to an overlapping phase b in which the delivery by cylinder 2 increases linearly and the delivery by cylinder 1 decreases linearly.

In the transition phase u lies a compression phase k in which after-cylinder 1 at first compresses the liquid drawn in and not until the end of the compression phase k does delayed delivery begin. The consequence is that the decrease in delivery by cylinder 2 in the compression phase k is not compensated by an increase in the delivery by cylinder 1. The total volume produced per unit time by the pump according to FIG. 3C shows an interruption F of delivery in its course which depends on the cam angle $\phi$ or time t. The actual pulsation amplitude produced by this interruption F in delivery is in the present case substantial and exceeds a given allowable pulsation amplitude P which is shown in FIG. 3C. The volume decrease in compression phase k in cylinder 1 resulting from compression has as a consequence that the suction phase of cylinder 1 begins with delay in a relaxation phase e in which the volume, because of pressure decrease, at first relaxes i.e. increases.

Noteworthy from FIGS. 3A and 3B is that the transition phases a and b extend typically over an angle of 45° based on a full rotation of the cam.

Figure 4A:
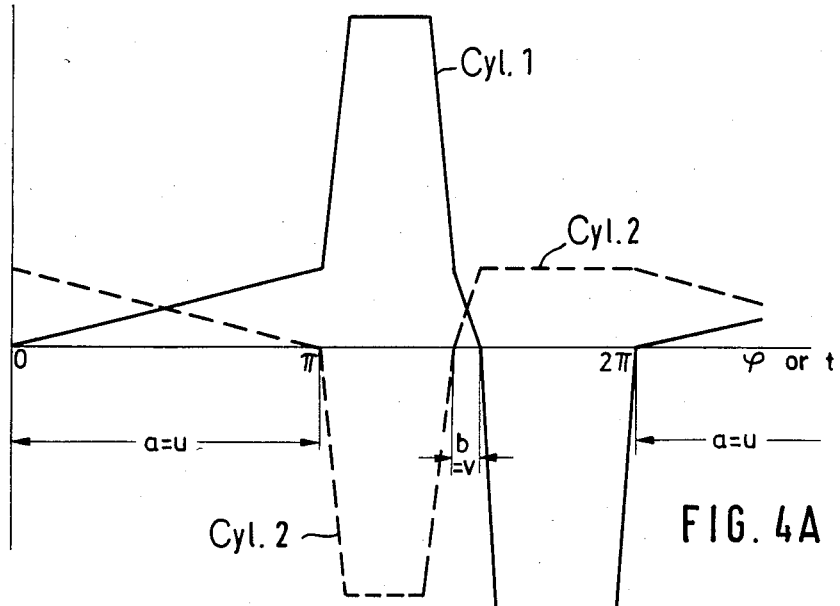
FIGS. 4A, 4B and 4C are diagrams from a displacement pump of the type shown in FIG. 2 which employ embodiments 1 to 3 according to the invention.
Figure 4B:
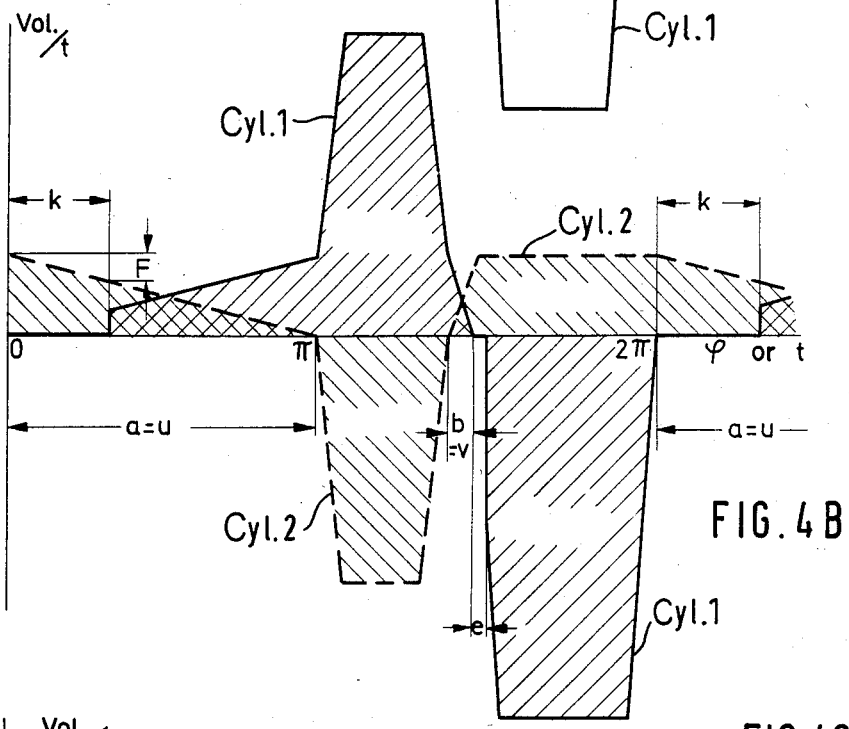
Figure 4C:
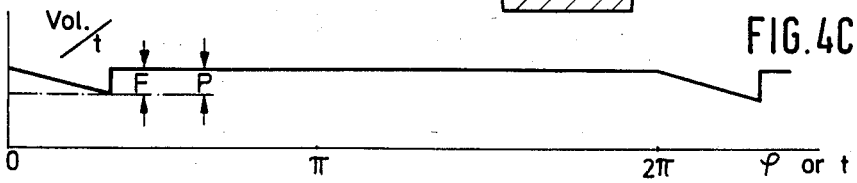

A decrease in the interruption F of delivery is obtained if, in accordance with FIGS. 4A to 4C, the transition region u before the delivery phase of after-cylinder 1 is prolonged to 180° in the present case. On addition to the transition region a, transition region b preceding the delivery phase of forward cylinder 2 can then be shortened by 15°. Through this measure compression phase k can be extended, at equal compression volume, over a doubled angle or doubled time. Since the increase in delivery by cylinder 1 or the decrease in delivery by cylinder 2 in the transition phase u also proceeds linearly here, the interruption F in delivery is only half so great in FIG. 4C as in FIG. 3C.

At this point it may be noted that the corresponding integrals (areas) of the curves in FIGS. 3B and 4B, which correspond to the delivery volume of each cylinder during a cycle, are equal. The relations shown are absolutely comparable.

Figure 5A:
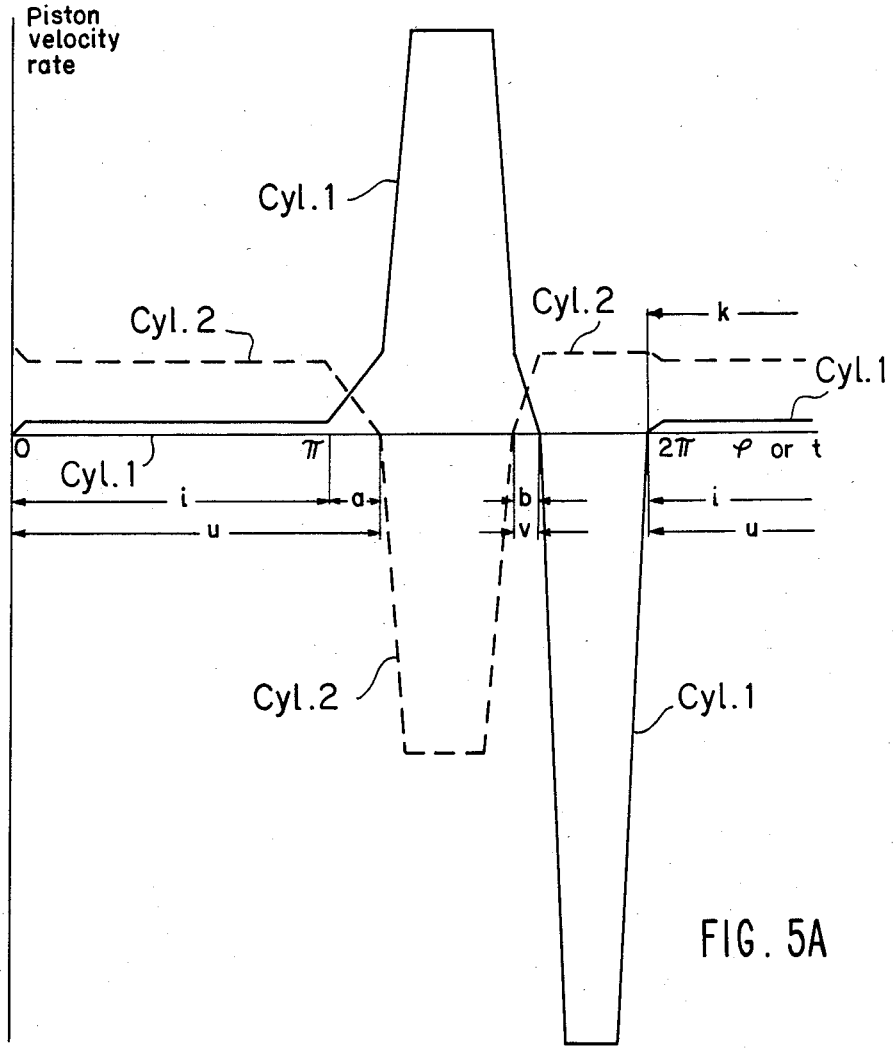
FIGS. 5A, 5B and 5C are diagrams for a displacement pump of the type shown in FIG. 2 which employ all four embodiments of the invention.
Figure 5B:
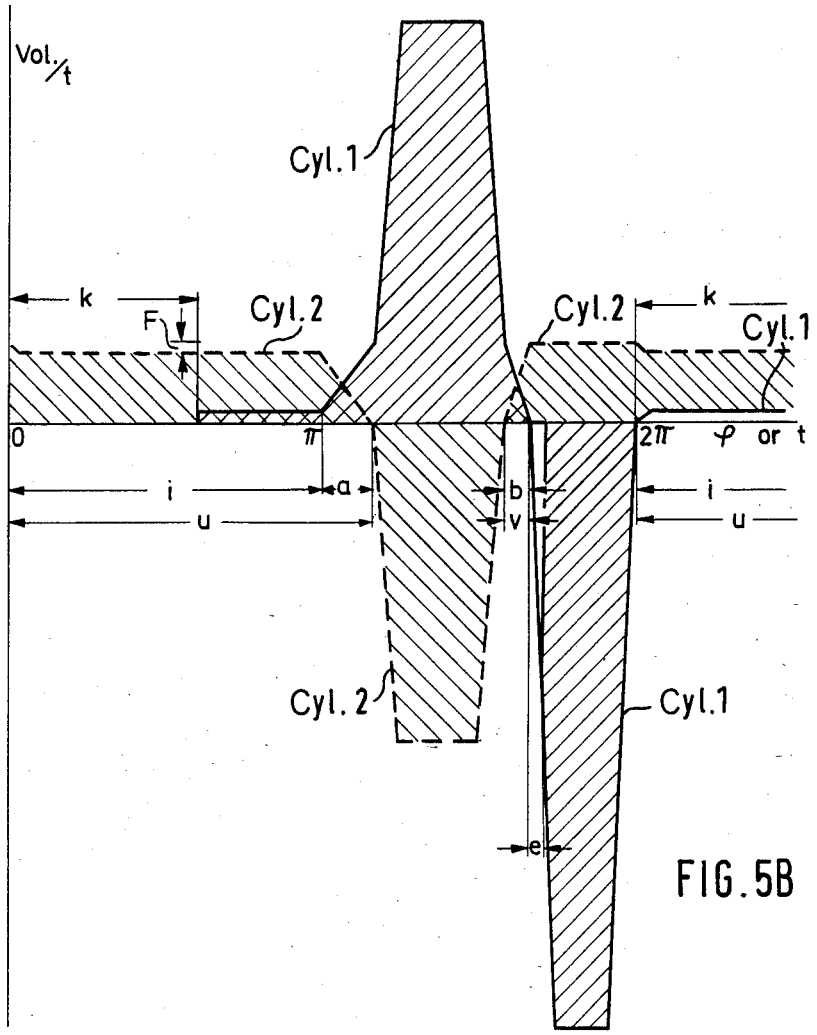
Figure 5C:
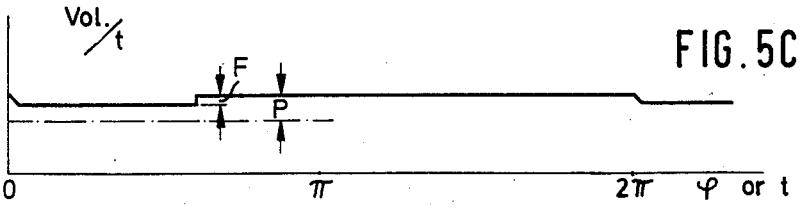

While in FIG. 4C the interruption F in delivery is exactly equal to the given tolerable pulsation amplitude P, if one operates according to FIGS. 5A, 5B and 5C, the interruption F in delivery for otherwise equal relations can be made substantially smaller than the tolerable given pulsation amplitude P. In contrast to the examples according to FIGS. 3 and 4, the transition phase u preceding the delivery phase of cylinder 1 is not identical to the overlapping phase a but transition phase u exhibits a so-called isocratic phase i together with the already known transition phase a. In the isocratic phase i the forward cylinder 2 continues its delivery at first in a decreased but constant degree. The delivery decrease determines the delivery interruption F. Simultaneously, the after-cylinder 1 begins in the isocratic phase i with a small but constant delivery which compensates for the decreased delivery which the forward cylinder 2 contributes to the afore-described total volume. The constant amount of delivery by the after-cylinder 1 in the isocratic phase i should, in order to keep the delivery interruption F small, be held as small as possible but sufficiently large that the compression phase k still lies within the isocratic phase. This is shown in the example presented. Here too, the proportional relations are comparable to those in FIGS. 3 and 4. This means that the compressed volume in the compression phase k is equal to that in FIGS. 3B and 4B. However, as can be seen from FIG. 5C, the delivery interruption F is substantially smaller than the given tolerable pulsation amplitude P.

In FIGS. 5A and 5B, the isocratic phase i extends over an angle of 180°. The transition phase u extends over an angle of 210°. The transition phase v preceding the delivery phase of the forward cylinder 2, which is identical with the overlapping phase b, extends here over an angle of 15°. Here also the latter has consequently been reduced with the augmentation of the isocratic phase i or the transition phase u.

In conclusion it can be stated by way of explanation that the delivery phase or the suction phase in the diagrams of FIGS. 3 to 5 have steep, although not vertical, beginning and end segments because vertical segments would signify infinite acceleration for the pistons. The delivery phases and the suction phases begin and end, consequently, where the steep segments begin or end, respectively.

What is claimed is:

1. A displacement pump for low-pulsation delivery of a liquid, comprising:

first piston pump means for receiving and delivering said liquid;

second piston pump means connected to said first pump means for receiving said liquid from said first pump means and delivering said liquid;

first cam means operatively associated with said first pump means for operating the piston of said first pump means in a suction phase, a delivery phase, and transition phases between said suction and delivery phases;

second cam means operatively associated with said second pump means for operating the piston of said second pump means in a suction phase, a delivery phase, and transition phases between said suction and delivery phases; and cam drive means for driving said first and second cam means at a constant speed with said cam means operating one of said first and second pump means in its suction phase while operating the other of said first and second pump means in its delivery phase;

said first cam means operating said first pump means in a first transition phase preceding its delivery phase substantially longer than a second transition phase prior to its suction phase and said second cam means operating said second pump means in a first transition phase prior to its suction phase substantially longer than a second transition phase prior to its delivery phase with said first transition phases of said first and second pump means being substantially equal;

said first cam means being so shaped as to increase the piston velocity of said first pump means during the said first transition phase at a rate which is substantially lower than the velocity decreasing rate of the said piston during said second transition phase of the first pump means whereby the interruption of delivery of said liquid due to compression of said liquid at the beginning of said first transition phase of said first pump means creates a pulse having an amplitude which is at most equal to a predetermined minimum acceptable pulsation value.

2. A displacement pump as set forth in claim 1 wherein said first cam means revolves at least 60° to operate said first pump means in said first transition phase preceding said delivery phase.

3. A displacement pump as set forth in claim 1 wherein said first cam means revolves at least 90° to operate said first pump means in said first transition phase preceding said delivery phase.

4. A displacement pump as set forth in claim 1 wherein said first cam means revolves at least 180° degrees to operate said first pump means in said first transition phase preceding said delivery phase.

5. A displacement pump as set forth in claim 1 wherein said first transition phase of said first pump means and second pump means includes an isocratic phase wherein the delivery of said liquid by said second pump means continues at a first substantially constant amount and the delivery of said liquid by said first pump means begins at a substantially constant amount to compensate for the decrease in the delivery of said liquid by said second pump means.

6. A displacement pump as set forth in claim 5 wherein said first cam means and said second cam means are so shaped that during said isocratic phase the velocity of the piston of said second pump means is higher than the velocity of the piston of said first pump means with both velocities being constant and the velocity of the piston of the second pump means is reduced relative to the velocity of the piston of the second pump means in the delivery phase by an amount substantially equaling the velocity of the piston of the first pump means in the isocratic phase.

* * * * *

UNITED STATES PATENT AND TRADEMARK OFFICE

CERTIFICATE OF CORRECTION

PATENT NO. : 4,600,365

DATED : July 15, 1986

INVENTOR(S) : Hansjurgen RIGGENMANN

It is certified that error appears in the above-identified patent and that said Letters Patent is hereby corrected as shown below:

Title page:

[30] Foreign Application Priority Data

February 4, 1982 [DE] Federal Republic of Germany
P32 03 722

Signed and Sealed this

Twenty-seventh Day of January, 1987

*Attest:*

DONALD J. QUIGG

*Attesting Officer*

*Commissioner of Patents and Trademarks*